United States Patent [19]

Vandergriff

[11] 4,094,043

[45] June 13, 1978

[54] ROLLER GIN WITH GROOVED SQUARE ROTOBAR

[76] Inventor: Arvel L. Vandergriff, 1701 Heffner St., Corcoran, Calif. 93212

[21] Appl. No.: 795,182

[22] Filed: May 9, 1977

[51] Int. Cl.[2] ..... D01B 1/06

[52] U.S. Cl. ..... 19/53

[58] Field of Search ..... 19/48-54

[56] References Cited

U.S. PATENT DOCUMENTS

| | | | |
|---|---|---|---|
| 418,908 | 1/1890 | Chase | 19/53 |
| 3,245,123 | 4/1966 | Brooks | 19/53 |
| 3,251,094 | 5/1966 | Vandergriff | 19/50 X |

FOREIGN PATENT DOCUMENTS

| | | | |
|---|---|---|---|
| 4,287 of | 1883 | United Kingdom | 19/54 |
| 293 of | 1890 | United Kingdom | 19/54 |

*Primary Examiner*—Dorsey Newton

*Attorney, Agent, or Firm*—Mason, Fenwick & Lawrence

[57] ABSTRACT

A roller cotton gin including a ginning roller and a stationary knife to which seed cotton is conveyed by the friction surface of the ginning roller for separating lint fibers from the cotton seed, and a rotary stripping blade device adjacent the stationary knife formed from a square cross section bar having V-shaped grooves axially spanning each face adjacent the corners providing blade formations for advancing the seed cotton deposited on the surface of the ginning roller to the zone of the stationary knife. The seed cotton is received in and advanced by the channel-like spaces between successive blade formations, and the stripping blade device has a diameter which is a small fraction of the ginning roller diameter and rotates at a speed causing the surface speed of the blade edges to approximately the same as the surface speed of the ginning roller such as to restrain seeds in the channel-like spaces during seed advancement over the pinch point at the edge of the stationary knife to a release point while the ginning roller strips lint from the restrained seeds and then releasing the seeds from blade restraint at the release point after they travel about ½ the staple length beyond the pinch point to return any incompletely ginned seeds still having attached fiber to the knife edge before the next blade applies advancing force to the seed and thereby withdraw substantially all the fibers from the seed. Flexible strip-like pads provided in the channel-like spaces to press the seed cotton against the ginning roller surface, and an auxiliary feed control roller and an unginned seed restraining and recycling comb structure are also disclosed.

21 Claims, 8 Drawing Figures

Fig-2
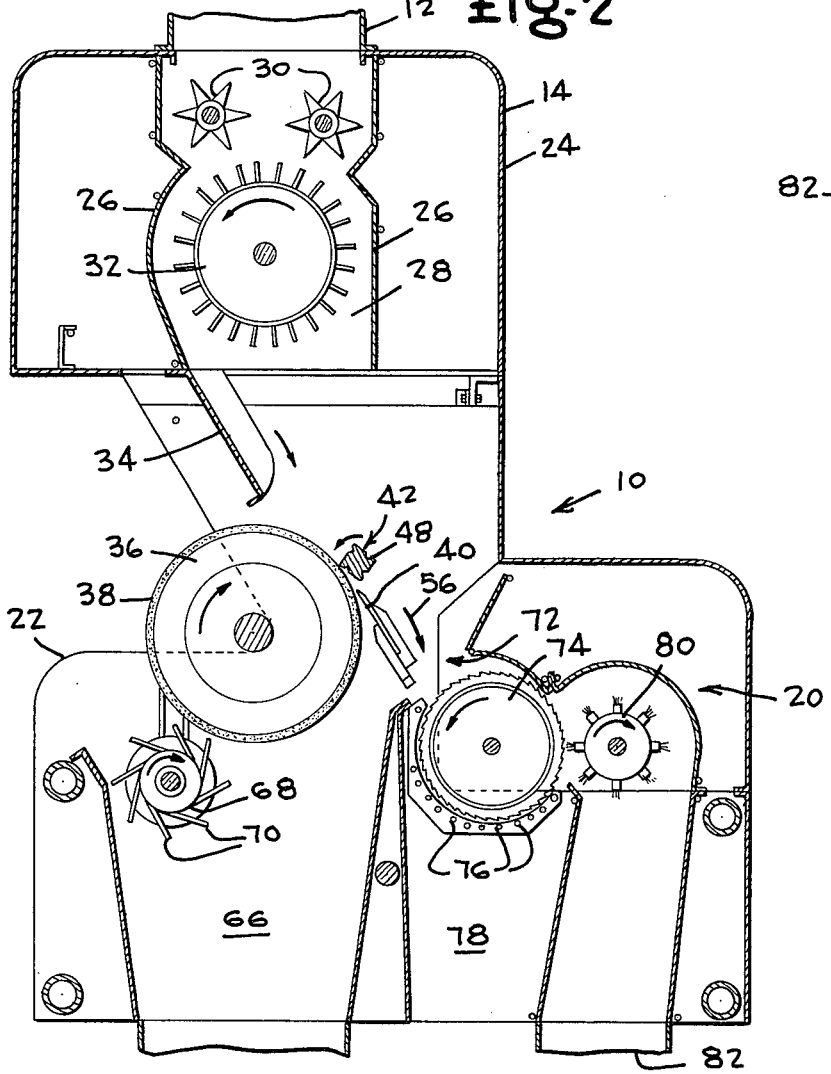
Fig-1
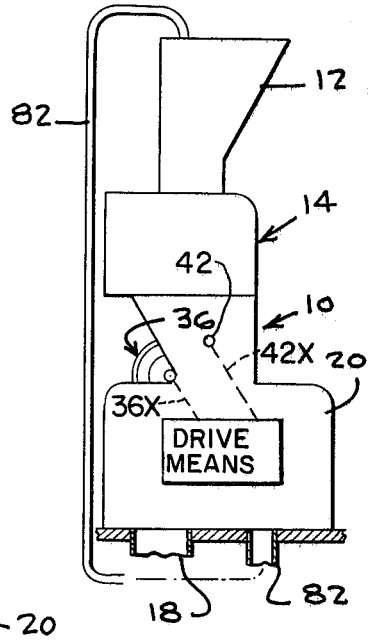
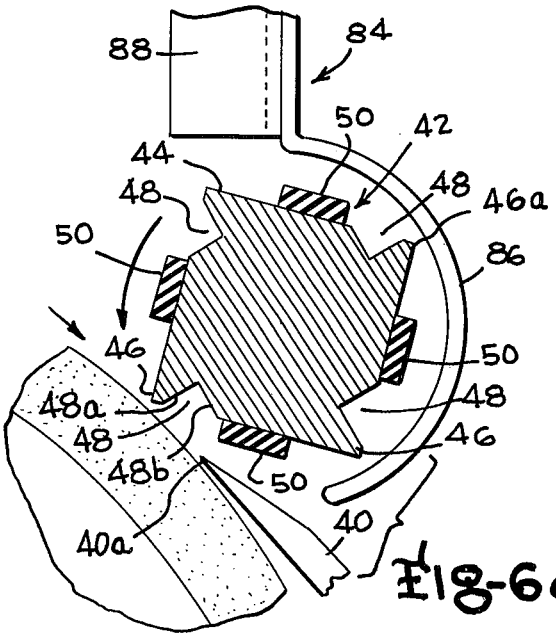
Fig-6a
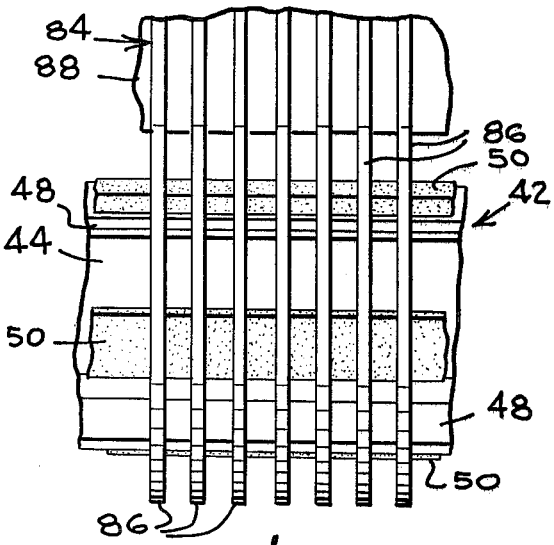
Fig-6b

ROLLER GIN WITH GROOVED SQUARE ROTOBAR

BACKGROUND AND OBJECTS OF THE INVENTION

The present invention relates in general to a cotton gin, and more particularly to a roller cotton gin constructed to strip lint from the seed of seed cotton with a high degree of efficiency and having high capacity.

The ginning of cotton, which is the operation in which the seeds are separated from the cotton fibers, is customarily carried out either in a saw gin or in a roller gin. The saw gin has been the dominant type for ginning the fuzzy seed Upland Cotton while the saw gin has not been acceptable for use on the Black Seed Cotton which generally has a longer staple. When ginning the extra long staple Black Seed Cottons, which are commonly referred to as a variation of Egyptian Cottons, on saw gin fiber, breakage results in a shorter staple and generally a less desirable fiber for the high-quality products for which this fiber is normally used.

To generally distinguish between these two basic types of cotton, by far the most common type of cotton is the Upland Cotton which varies in staple length from less than ¾ inch to more than 1⅛ inch. The seeds are fuzzy and each fiber is firmly attached to the seed. The cotton is almost always saw ginned, although there are periodic efforts to roller gin the longer staple varieties to better preserve the fiber quality.

The other type of cotton is sometimes referred to as Black Seed Cotton, but more commonly referred to as extra long staple cotton. The staple length of this cotton varies widely as with the Upland Cotton but the more common varieties are about 1⅜ inch to 1½ inch in staple length. The fibers are very fine and silky and can be used in very expensive materials. Saw gins break and tangle these fine fibers which lowers their quality. Also, the fibers are so gently attached to the slick surface of the seed, the performance of the saw gin is not very satisfactory. For these reasons, this Black Seed Cotton is almost always roller ginned.

A particular disadvantage has been encountered heretofore in connection with roller gins in that, whereas a saw gin produces fibers continuously, roller gins heretofore used are somewhat intermittent in operation. This occurs because of the fact that there is a reciprocating blade employed that cooperates with the ginning roller and a stationary doctor knife to strip the seeds from the fibers as the fibers are drawn past the doctor knife by the ginning roller. The reciprocation of the moving blade serves to interrupt the flow of cotton to the ginning roller so that in this type of roller gin, the productive rate of the roller gin has been relatively slow. The high quality of the fibers produced by a roller gin, however, have caused it to continue in use, particularly in regions where the cotton is characterized by particularly long fibers.

Various attempts have been made to improve the roller cotton gin and, in particular, to improve the gin with respect to the rate of fiber production in order to reduce the cost of ginning the Black Seed Cotton, while at the same time retaining the advantageous characteristics of the roller gin that the fibers produced are not entangled or broken.

Much effort has been given to alleviating difficulties with the length of time required in roller gins to pull the fibers from the seed, particularly long fibers, and to dislodge the seed from the fibers with the seeds in a relatively fiber-free condition, and do this continuously at a relatively high rate of speed. This has led to the construction of a roller gin having a ginning roller turning against a stationary knife so that the fibers will be drawn under the knife while the seeds are retained, and utilizing with this construction rotary or continuously moving knife means to knock the seeds away from the stationary knife. Difficulties have been encountered however in producing clean seeds with this construction because not enough ginning time was given to pull the fibers off the seeds and some considerable seed cracking occurred.

In the case of roller gin employing a reciprocating blade for the purpose of disloding the seeds from the stationary knife, it has been proposed to have the moving blade overlap the stationary knife by about ½ the length of the staple of the cotton being ginned. Fibers are pulled, by friction of the ginning roller, under the knife until the seed is against the knife edge. The friction is not always great enough to pull all the fibers from the seed, in which case it is necessary for the blade to push the seed away from the knife's edge. In the case of the reciprocating blade, it operates parallel and close to the top surface of the blade to push the seed away. If the seed is not pushed beyond the length of most of the fibers, the friction on the fibers still held between the roller and the knife will draw the seed back to the knife, at which time most if not all the fibers are removed. It is difficult to determine accurately how many times an individual seed returns before all fibers are removed, as this depends on a number of variables, the most obvious one being the pressure of the ginning roller against the knife. The pressure can be enough for the friction to remove practically all the fibers as the seeds are pushed away by the blade. However, such pressure will usually cause the roll to overheat.

The overlap of the reciprocating blade of approximately one half the staple length has been accepted by those experienced in ginning extra long staple cottons for many years. The fact that the reciprocating blade completely blocks the access of the cotton to the ginning roller during its travel across the knife limits the capacity of such a method drastically. The economics of this method limit its use to the very longest staple of high quality whose value would be greatly reduced by saw ginning.

Literally hundreds of roller ginning machines have been designed in an effort to increase the capacity and thus reduce the cost of roller ginning. In spite of these efforts the reciprocating blade method prevailed through the 1950's. Subsequently, as a result of work by some engineers engaged in a program to prove methods of roller ginning at the United States Department of Agriculture's Ginning Laboratory at Mesilla Park, N. Mex., there appeared in about 1961 a roller gin design using square bars mounted on a driven chain system to travel over a knife, allowing the cotton to be fed to the ginning roller between the bars. This was called "the flight bar gin". Several companies manufactured and installed elaborate and expensive plants using the flight bar gin principle, but these plants were not successful, because it was not possible to maintain the required pressure on the flight bars as they moved over the knife, since sprocket and chain wear necessitated constant adjustment.

In analyzing the difficulties encountered with the flight bar gin and studying the art, I concluded that a rotating blade would serve the same purpose as the flight bar or the old reciprocating bar and permit attainment of improved roller ginning. Study of the art showed that rotating blades, such as blades on a rotating cylinder, had been previously tried and found to be unsuccessful, but the rotating cylinders with blades in those cases were approximately the diameter of the ginning roller which allowed for an overlap much greater than the staple length. I determined that many of the problems previously encountered with such large diameter rotating blades or with the flight bars should be alleviated by using a rotating blade about 2¾ inches in diameter and an overlap with the knife of about ¾ inch and a number of roller gins having this dimensional relationship and arrangement have been previously used for cottons having a staple length of, for example, about 1⅜ inch to 1 ½ inch.

I have devoted considerable study to investigation of the optimum diameter, speed and configuration of the rotating blade device and the overlap, particularly with regard to roller ginning of the shorter staple cotton. My studies indicate that for Upland Cotton, the blade device should be about 2 inches in diameter to achieve optimum release of the seed after about ½ inch to ⅝ inch movement. In considering the configuration to maintain the required rigidity with such a small diameter blade and the number of blades to be provided, the R.P.M. is a factor. A study of the relationship of the surface speed of the rotating blade to that of the ginning roller indicates that the ratio should approach 1:1. If the ginning roller, as it approaches the ginning point, is fully covered with cotton, and the surface speed of the rotating blade is significantly less than that of the ginning roller, there would be intermittent build-ups of cotton ahead of the rotating blade as each blade comes into ginning position. These build-ups overload the ginning capacity of the ginning roller intermittently, resulting in the necessity to cut back the feed. The build-ups can be eliminated by setting up the surface speeds of the ginning roller and rotating blade to be close to the same speed.

With this established, the question of the number of blades on the rotating blade assembly can be determined within reasonable limits. As the seed is pushed away from the ginning point to the release position it must have time to return to the ginning point before the next blade moves to the ginning point. The travel of the ginning roller surface must be enough to pull the seed back to the knife before the next blade reaches the knife edge.

It has been determined that for Upland Cotton, a rotating blade assembly of about 2 inches in diameter and having four blade points or blade members more nearly meet this criteria. As one means of achieving this in a simple manner, I have used a 1½ inch by 1½ inch square cross section bar which is machined to a configuration to provide four blade formations at the four corners by providing a V-cut vein or groove spanning the axial length of the bar immediately adjacent each of the four corners on the side thereof in the direction of rotation of the rotating blade assembly. The diagonal dimension of this square bar is 2.12 inches, which is very close to the calculated 2 inch diameter determined to be appropriate to meet these criteria. This grooved square cross section rotating blade or rotobar, when arranged adjacent the ginning roller and the stationary knife, has shown capacities which are much superior to any obtained on prior units, particularly where a reasonably low residual lint on the seed is maintained. By this arrangement, the rotating blades formation at the corners of the square bar with the V-cut grooves move the seed away from the knife edge, and then allow them to return to the knife edge before the next blade hits the seed, and maintains a surface speed relationship of the two rollers that will avoid an accumulation of unginned cotton on the ginning roller ahead of the rotating blade. Of course, if more than four blades are used on the rotating blade assembly, the speed of the rotating blades has to be reduced or the speed of the ginning roller increased to avoid having the blade hit the seed before it returns to the knife edge, thus leaving lint on the seed. For extra long staple, of the order of 1¾ inch to 1½ inch, the diameter of the four point rotating blade assembly may be increased to approximately 3 inches.

While such a roller gin with the grooved sqaure cross section rotobar or rotary blade device having approximately a 1½ inch by 1½ inch square cross section for Upland Cotton achieved the desired result of pushing the seed away from the ginning point to the release position and then allowing it to return to the ginning point before the next blades moves to the ginning point, to achieve high capacity ginning, it was found that a certain number of seed locks are carried over the point of contact of the stationary knife and the ginning roller surface, referred to as the pinch point, without being ginned. This was primarily due to the fact that they are carried rapidly by the blades of the rotary bar device and the fibers failed to get picked as they crossed the pinch point. These unginned locks would then be intermingled with the ginned seed and be reclaimed and returned through the system. I have discovered that by providing a pad or strip of flexible material on the flat surface of the square cross section grooved rotary bar device of such dimension as to press the seed locks against the ginning point, the percentage of unginned seed locks is drastically reduced and the capacity is increased accordingly. Preferably, use of a piece of felt or sponge rubber, for example about ¼ inch by ⅝ inch in cross section, bonded to the center of the flat surface and spanning the length of the rotary bar device provides satisfactory results. This expedient of providing a pad of flexible material along the midregion between successive blades of a rotobar or rotating blade assembly also improves the performance of conventional rotary blade devices formed of a round center shaft and 4 or more radial blades having the flexible pads in the base region of each pocket between successive blades.

An object of the present invention, therefore, is the provision of a novel roller gin construction having a rotating blade or rotobar device of small diameter and novel construction arranged immediately adjacent the working or leading end of the stationary knife, having an appropriate configuration and surface speed and spacing between blades to move the seed away from the knife edge and then allow it to return to the knife edge before the next blade hits the seed, and maintaining the surface speed relationship between the rotating blade assembly and the ginning roller so as to avoid an accumulation of unginned cotton on the ginning roller ahead of the rotating blade.

Another object of the present invention is the provision of a novel roller gin having a rotating blade or rotobar device of small diameter relative to the diameter of the ginning roller formed of square cross section having V-shaped veins or grooves immediately adjacent the corners to define seed-engaging blades and seed receiving pockets therebetween so correlated to the seed size and to the speed of rotation of the ginning roller and the rotating blade device as to cause the seed to be pushed away from the ginning point or pinch point to a release point by engagement with the blade-like surfaces on the rotating blade device and then have time to return to the pinch point before the next blade-like surface moves to the pinch point, the release point being such that the seeds are not pushed out of the ginning zone with fibers still attached.

Yet another object of the present invention is the provision of a novel roller gin construction having a rotating blade device adjacent the edge of the stationary knife provided with plural blades transversely spanning the width of the gin formed from a square cross section member providing a blade device of small diameter compared to the diameter of the ginning roller having a surface speed close to the surface speed of the ginning roller, and having flexible pads between the successive blades to press the cotton seed locks against the ginning point and reduce the percentage of unginned locks.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 1 is a diagrammatic elevational view of a roller cotton gin embodying the present invention;

FIG. 2 is a vertical section view through the roller gin of the present invention, taken substantially along the longitudinal mid-plane of the gin;

DETAILED DESCRIPTION OF PREFERRED EMBODIMENTS

Figures 3, 4, 5, 5A:
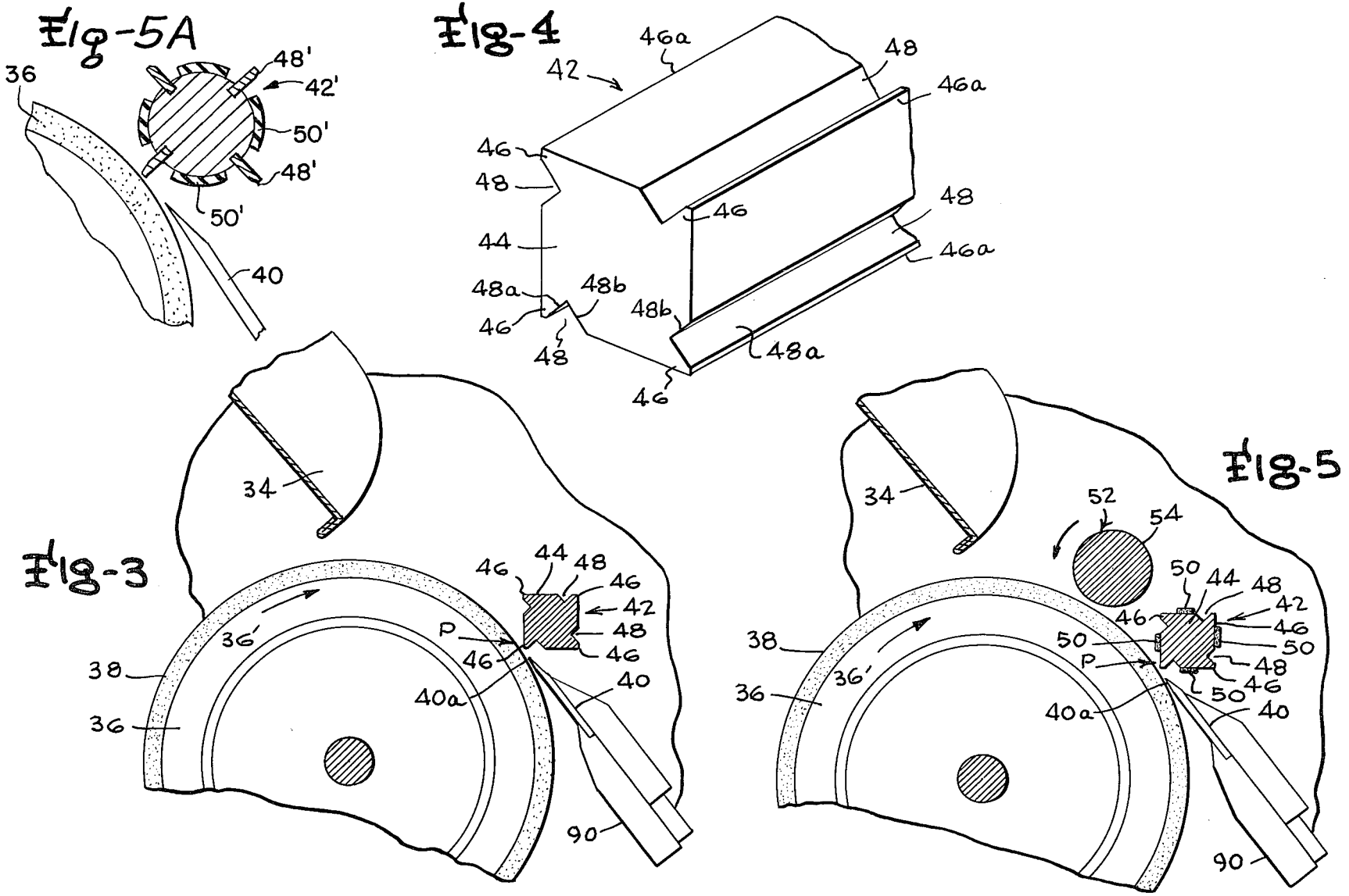
FIG. 3 is a fragmentary vertical section view, to enlarged scale, showing the rotating blade device and the stationary knife and ginning roller portions of the gin.
FIG. 4 is a fragmentary perspective view of the blade device used with the roller gin of the present invention.
FIGS. 5 and 5A are fragmentary section views similar to FIG. 3, illustrating modified forms of roller gin embodying the present invention, FIG. 5A having an auxiliary roller associated with the rotating blade device; and FIGS. *6a* and *6b* are end elevation and fragmentary front elevation views of a modification wherein a comb or rib device is associated with the rotating blade assembly to return unginned locks to the ginning process.

Referring to the drawings, wherein like reference characters designate corresponding parts throughout the several figures, and particularly to the embodiments shown in FIGS. 1 to 4, the roller cotton gin of the present invention is indicated generally by the reference character 10, and in customary fashion, may be preceded by a distributor, indicated generally at 12 in the diagrammatic elevational view of FIG. 1, with a feeder, indicated generally at 14, interposed between the distributor 12 and the roller cotton gin 10. The cotton to be ginned is fed into the machine by way of feeder 14, in one suitable example, and the lint fibers that are separated from the seed are discharged into a lint duct or flue 18 for transporting the fibers to the subsequent processing station, such as a battery condenser, lint cleaner or other known lint processing equipment. The gin may be provided with any of a number of arrangements for reprocessing or reclaiming unginned locks. As one example, a comb or rib structure as shown in FIGS. *6a, 6b,* and as hereinafter described, may be provided to return unginned locks around the rotary blade device to the pinch point for reprocessing. As another example, there may be associated with the gin, as illustrated in FIGS. 1 and 2, a reclaiming station as indicated diagrammatically at 20, where the unginned seeds that may pass the ginning station are separated from the ginned seeds and conveyed by a suitable return duct back to the distributor or other suitable point in the plant.

The structure of the roller gin, and the associated feeder 14 and the optional reclaiming unit 18 is illustrated in the vertical section view of FIG. 2. The roller gin stand comprises, in accordance with usual practice, a frame 22, made up of sheet metal and suitable bracing members to support the various operating components of the gin and also provide support for the associated seed cotton feeder 14 which mounts on top of the frame 22. The seed cotton feeder 14 includes a housing 24, also typically formed of sheet metal and bracing members, having shaped interior sheet metal partitions 26 transversely spanning the width of the feeder and extending through the total height thereof defining a generally vertically arranged passage 28 for transfer of the seed cotton from the lower outlet of the feeder 14 to the gin stand. Movement of the seed cotton through the passage 28 of the feeder is controlled by a pair of feed rollers 30, which are usually driven by an automatically controlled variable drive mechanism, in accordance with conventional practice, in correlated relationship to the feed requirements of the gin, and transfer the cotton to the zone of action of the large feed wheel 32 delivering the seed cotton to the downwardly inclined slide 34 within the upper portion of the gin stand 10.

The cotton being delivered at a controlled rate from the lower discharge end of the feeder 14 and downwardly along the inclined slide or feed chute 34 is deposited by gravity onto the top of the ginning roller 36 which has a friction surface or cover 38 of leather or rubber-like material of such a nature that the fibers of the cottom tend to adhere thereto so that the cotton is carried around the ginning roller in the direction of the arrow 36' toward the stationary ginning knife 40. To cooperate with the ginning roller 36 and stationary ginning knife 40 in removing seed from the seed cotton, a rotating blade seed stripper member, which I refer to as a rotobar blade assembly 42 is provided immediately adjacent the leading or upstream edge 40*a* of the ginning knife, for example, with its center axis laying substantially in the radial plane extending from the center axis of the ginning roller 36 through the leading edge 40*a* of the ginning knife.

The rotobar blade assembly 42 of the present invention is formed of a 1½ inch by 1½ inch square cross section bar for Upland Cotton, and a 2 inch by 2 inch square cross section for extra long staple, having for example, cylindrical outer ends of the same or slightly smaller diameter than the thickness of the bar journaled in suitable bearings (not shown) in the side wall of the gin stand. The square cross section portion 44 of the bar extends substantially the full width of the gin stand and is machined to a configuration to provide 4 blade formations 46 at the 4 corners of the square bar portion by providing a V-cut vein or groove 48 spanning the axial length of the square bar portion 44 immediately adjacent each of the 4 corners on the side thereof in the direction of rotation of the rotating blade assembly, whereby one of the sides 48*a* of the V-cut forms a blade surface facing forwardly relative to the direction of rotation of the rotorbar 42 to engage and move the seeds over the leading edge of the stationary knife 40. In one specific example, the 1½ inch by 1½ inch square cross section bar is machined to provide cylindrical end portions having a diameter of about 1 7/16 inch to be journaled in the bearings at the sides of the gin stand and the V-cuts 48 adjacent the 4 corners 46*a* of the square cross section bar portion 44 are cut to provide sides 48*a* and 48*b* which are each at approximately 45° angles to the surface of the bar in which they are cut with each of the sides 48*a*, 48*b* having a width of about 5/16 inch, the edge of the V-cut side 48*a* intersecting the surface of the bar portion 44 in which it is cut approximately 1/16 inch from the adjacent corner 46*a* and the other side 48*b* of the V-cut intersecting the bar surface approximately ½ inch from the adjacent corner 46*a*. The diagonal dimension of this square bar is therefore approximately 2.12 inches, providing the small diameter rotating blade assembly which can be conveniently operated at speeds appropriate to release the seed after about ½ inch to ⅝ inch movement, or about half the staple length, after the seed is moved over the edge 40*a* of the stationary knife 40 at the pinch point P. While the use of such a rotobar or rotary blade assembly 42 as above described provides capacities much superior to those obtainable with prior roller gins, the number of unginned locks which may pass over the point of contact of the stationary knife with the ginning roller surface, which would have to be reclaimed or reprocessed in some manner, can be further reduced by providing on each of the flat faces of the square cross section portion 44 of the rotobar 42 which form the surfaces which extend inwardly from the cylindrical paths swept by the edges or corners 46*a* of the blade formations 46, a pad of flexible material in strip form, as indicated at 50 in FIGS. 4 and 5, substantially centered on the associated side of the rotobar and extending the axial length of the square cross section portion 44. For example, the flexible pad strip 50 may be formed of felt or sponge rubber, having a cross-sectional dimension of about ¼ inch by ⅝ inch, bonded to the center of the flat surface of the associated side of the rotobar and extending the length of the square cross section portion thereof. The pad 50 should be flexible or soft enough to avoid crushing of the seed against the ginning roller, and serves to press the seed locks against the ginning point as the blade formations 46 engage and move the seeds across the top of the pinch point and the edge of the stationary knife 40.

I have also found that the small diameter of the rotobar blade device 42 may sometimes cause an uneven flow of cotton between it and the ginning roller, when for example, some of the cotton approaches the rotobar above its center line. A smoother, more uniform feed of the seed cotton to the rotobar device and the knife can be obtained by the arrangement of FIG. 5, where there is provided an auxiliary feed control roller 52 spaced slightly upstream from the rotobar blade assembly 42 and located between the latter and the discharge end of the slide or feed chute 34. The auxiliary feed control roller 52, as shown in FIG. 5, is formed of a cylindrical smooth surfaced roller member 54, having, for example, a diameter of about 2 15/16 inches (for the 1½ inch by 1½ inch rotobar) and reduced diameter ends journaled in bearings in the side walls of the frame 22 and positioned so that the cylindrical surface 54 passes very close to the surface of the ginning roller 36 during rotation of the auxiliary feed control roller 52.

By suitable means known to those skilled in the art, such as pulleys and motor drive belts, not shown, the ginning roller 36, rotobar blade assembly 42, and auxiliary feed control roller 52 are driven by drive means diagrammatically indicated at 36X and 42X in FIG. 1, in the directions indicated by the arrows and at appropriate speeds to sweep the outer free edges of the blade formations 46 of the rotobar 42 in the direction indicated by the arrow 42*a*, to move them inwardly toward the friction surface 38 of the ginning roller 36 and into the closest proximity to the surface 48 at the pinch point P just in advance of the leading or forward edge of the stationary knife 40. The stationary ginning knife 40 bears on the friction surface 38 of the ginning roller 36 adjacent the rotobar blade assembly 42, and the fibers or lint of the cotton locks are drawn beneath the stationary ginning knife 40 while the seeds are prevented from passing beneath the knife because there is not sufficient clearance for the seeds. The fibers are thus pulled from the seeds by the friction surface 38 of the ginning roller as the ginning knife 40 restrains the seeds against movement and the seeds are discharged above the ginning knife in the direction of the arrow 56. The fibers or lint pulled under the ginning knife 40 by the friction surface of the ginning roller 36 pass into the outlet chamber 66 which communicates with the lint duct or lint flue 18, while those fibers which remain adhered to the friction surface 38 of the ginning roller 36 may be stripped therefrom, in accordance with conventional practice, by providing a doffing roller 68 having flexible rubber-like blades 70 which serve to strip the fibers from the friction surface.

It will be apparent that the use of the pads of flexible material spanning the axial length of the working portion of the rotobar between the blade formations is, in effect, located in the base or bottom surface of the channel-like pockets formed between successive circumferentially spaced blade formations, serving to resiliently push the seed locks into the pinch point. This use of flexible material attached to the base surface portion of these channel-like formations also would serve a similar purpose in rotating blade assemblies of the type shown in my earlier U.S. Pat. No. 3,251,094, for example, wherein blades are provided as a plurality of radial flat blade members fixed in a cylindrical center shaft forming channel-like pockets between the successive blades as illustrated in FIG. 5A, where the pads 50' are provided between the blades 48' of the blade assembly 42'. In either case, the flexible filler or pad between the successive blades resiliently urging the seeds in the channel-like pocket formations against the friction surface of the ginning roller further increases the assurance that at least a few fibers of each seed lock will be caught between the knife 40 and the ginning roller surface 38 as the seed cotton is moved to the pinch point. Once a few fibers of the seed lock are caught between the stationary knife and the ginning roller surface, usually all of the fibers are then pulled from the seed before the seed is finally released to be discharged from the gin stand, since the seed is released from the blade which just carried it over the pinch point after travel for about ½ the staple length of its fibers and thus is drawn back to the pinch point and engaged and moved by the next successive blade advancing to the pinch point so long as fibers remain on the seed and some fibers are caught between the knife and the ginning roller surface.

In the event the reclaiming device indicated generally at 20 in FIG. 1 is associated with the roller gin, seeds that are discharged along the path indicated by the arrow 56 above the ginning knife 40, after the lint has been removed from them, pass down a seed chute 72 and are subjected to reclaiming processing by delivering them into the working zone of a rotary saw 74, for example, where the lint fibers still adhered to the seed that have not been completely cleaned of lint are caught by the seed of the saw and carried past stationary bars 76 through which the cleaned seeds pass and are removed through outlet passages 78. Seeds which still have sufficient lint on them to remain caught on the saw teeth are carried to the doffing zone where the doffing brush 80 removes them from the saw teeth and the incompletely ginned seeds with adhering lint fibers are then delivered by a return duct 82 back to the inlet side of the cleaner and extractor 12.

Alternatively, an arrangement such as that illustrated in FIGS. *6a, 6b* may be provided, where, instead of providing the reclaiming mechanism described above, a simple wire comb or rib-like structure 84 is provided adjacent the rotobar blade assembly 42, formed of a plurality or arcuately curved wire fingers 86 supported in downwardly extending relation from a supporting block 88 and extending in a concave, substantially semicylindrical path facing toward and substantially concentric with the axis of the rotobar 42. The curved wire fingers 86 lie in parallel vertical planes perpendicular to the axis of the rotobar with the curved portions thereof spaced just outwardly of but close to the free edges or corners of the blade formations 46, and are spaced transversely apart a proper distance to permit passage of seeds therebetween but to return unginned cotton to the ginning process by causing them to be carried back across the top of the rotobar and down again to the pinch point P.

The ginning knife 40 is rigidly mounted in the supporting frame 90 fixed in the housing of the gin stand, while the ginning roller 36 may be movably supported so that it can be adjusted toward and away from the stationary knife 40 and be caused to engage the knife 40 under varying degrees of pressure. The roller gin of the present invention operates to provide for highly efficient ginning because of the action of the altered square cross section rotobar 42 with its blade formations 46 and the stationary knife 40 and friction surfaced ginning roller 36, and the correlation of sizes and surface speeds thereof. It will be appreciated that the blade formations 46 of the rotobar 42 rotate in such a path that the outer tips or free edges of the blades described a circular or cylindrical path whose diameter is a small fraction, less than about one-fifth, of the diameter of the ginning roller 36, and the blade formations 46 define between them a series of resilient-pad-bottomed pockets or channels which receive the unginned seed cotton discharging from the feed chute 34 onto the upwardly facing surface portion of the ginning roller 36 and carried thereby into the zone of action of the rotobar 42. Assuming a 15 inch diameter ginning roller 36 operating in the range of about 135 R.P.M. with Upland Cotton, the rotobar surface speed should be of the order of about 10 percent less than the speed of the ginning roller, or about 860 R.P.M., with a rotobar of the size described to provide the proper high capacity and effective ginning of the Upland Cotton cotton.

When the seed cotton enters the channels or pockets formed between the blade formations of the rotobar 42, and reaches the pinch point P, the fibers are drawn under the stationary knife 40 by their adherence to the friction surface of the ginning roller 36 while the seed is restrained against movement thereunder by the working edge of the stationary knife. The diameter of the rotobar 42 and its surface speed relative to the surface speed of the ginning roller are such that the seed carried through and beyond the pinch point while the fibers are being drawn therefrom beneath the knife 40 are released by the blade surface **48*a* of the rotobar which advanced then, after a travel of about ½ the staple length from the pinch point, so that the seed is allowed to return to the knife edge before the next blade surface 48*a* hits the seed. The travel of the ginning roller 38, of course, is enough to pull the seed back to the knife 40 before the next blade surface 48*a* reaches the knife edge 40*a*, and thus the ginning roller 36 and stationary knife 40** coact to withdraw substantially all of the fibers from the seed so long as sufficient fibers remain attached to the seed to continue drawing the seed back to the pinch point after each release by the traveling blade surfaces. Tests of this construction have shown capacities which are much superior to any obtainable on prior roller gins, particularly where a reasonably low residual lint on the seed is maintained. For example, ginning Upland Cotton with as low as 6.6 percent residual lint with a 4 blade rotobar producing 2 bales per hour have been attained, whereas about 12 percent residual lint occurs when the same cotton is ginned on a conventional saw gin.

What is claimed is:

1. A roller cotton gin comprising a ginning roller having a friction surface for conveying lint fibers to a pinch point station and a fixed knife for separating the lint fibers from cotton seed having an upstream facing working edge at the pinch point located substantially tangentially of and in contact with the surface of said ginning roller, a rotary feed blade rotobar member spanning the width of the gin having a center axis and shaped at circumferentially spaced locations to form at least four forwardly facing blade surface formations spanning the gin width having outer edges located to sweep through an arcuate cylindrical path whose diameter is a small fraction of the ginning roller diameter downwardly toward, over and forwardly beyond the edge of the knife and the rotobar member having outwardly facing interconnecting surfaces between the successive blade formation edges shaped to extend from said cylindrical path inwardly to locations nearer to said center axis effectively forming seed-receiving spaces between successive blade surfaces for advancing the seed cotton coactively with the ginning roller surface toward and over the knife edge, means for rotating the ginning roller at a predetermined surface speed, means for feeding seed cotton to the surface of the ginning roller at a location upstream of said knife edge to cause the ginning roller to strip lint from seeds which are restrained by the knife edge and convey the lint to a point of removal, and means for rotating said rotobar member at a speed causing the surface speed of the edges of said blade surfaces to be slightly less than the surface speed of said ginning roller such as to restrain seeds in said seed-receiving spaces during seed advancement over said knife edge from said pinch point toward a release point while the ginning roller strips lint from such restrained seeds and then releasing the seeds from blade restraint at said release point spaced from the pinch point a distance whereby the fiber attached to any incompletely ginned seeds in sufficiently held between the knife and ginning roller to cause return of the incompletely ginned seed to the knife edge before the next blade applies advancing force to the seed, thereby to witdraw substantially all the fibers from the seed so long as sufficient fibers remain attached to the seed to continue drawing the seed back to the pinch point after each release thereof, and a narrow strip-like pad of flexible material fixed on and spanning the axial length of each of said outwardly facing interconnecting surfaces substantially midway between each of the successive blade formation edges to press the seed locks in said seed- receiving spaces between successive blade formation edges against the ginning roller surface immediately upstream of said working edge of said knife and reduce the occurrence of unginned locks.

2. A roller cotton gin as defined in claim 1, wherein the rotobar member includes a grooved square cross section bar portion having an elongated recess adjacent each corner which is a rectilinear trough-like groove of substantially V-shaped cross section formed in a respective one of the four flat faces of the square cross section bar portion located at the trailing edge of the flat face relative to the direction of rotation thereof, the sides of said V-shaped grooves nearest said corners forming said forwardly facing blade surfaces and lying in planes extending radially from the center axis of the bar portion.

3. A roller cotton gin as defined in claim 1, wherein the rotobar member includes a grooved square cross section bar portion having an elongated recess adjacent each corner which is a rectilinear trough-like groove of substantially V-shaped cross section formed in and occupying a minor portion of the area of a respective one of the four flat faces of the square cross section bar portion located at the trailing edge of the flat face relative to the direction of rotation thereof, the sides of said V-shaped grooves nearest said corners forming said forwardly facing blade surfaces and lying in planes extending radially from the center axis of the bar portion.

4. A roller gin as defined in claim 1, wherein the cylindrical path traversed by the edges of the blade formations has a diameter of between about one-fifth and one-seventh the diameter of the ginning roller.

5. A roller gin as defined in claim 1, wherein the cylindrical path traversed by the edges of the blade formations has a diameter in the range of between about 2.0 and 3 inches and the ginning roller has a diameter of about 15 inches.

6. A roller gin as defined in claim 1, wherein the cylindrical path traversed by the edges of the blade formations has a diameter in the range of between about 2.0 and 3 inches and the ginning roller has a diameter of about 15 inches and the surface speed of the edges during ginning being less than but within 90% of the surface speed of said ginning roller.

7. A roller cotton gin as defined in claim 1, including a driven auxiliary feed control roller located closely adjacent the surface of the ginning roller spaced a predetermined distance upstream from said rotobar member between the latter and the region where the seed cotton is fed to the ginning roller surface to facilitate even flow of cotton between the rotobar member and said surface and resist flow of seed cotton over the top of the rotobar member.

8. A roller cotton gin as defined in claim 7, including a comb structure adjacent the rotobar member for returning incompletely ginned cotton seeds to the pinch point for reprocessing comprising a rib-like comb spanning the blade formations having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

9. A roller cotton gin as defined in claim 1 including a comb structure adjacent the rotobar member for returning incompletely ginned cotton seeds to the pinch point for reprocessing comprising a rib-like comb spanning the blade formations having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

10. A roller gin as defined in claim 2, wherein the cylindrical path traversed by the edges of the four corners of the square cross section portion of said rotobar member has a diameter of between about one-fifth and one-seventh the diameter of the ginning roller.

11. A roller gin as defined in claim 2, wherein the cylindrical path traversed by the edges of the four corners of the square cross section portion of said rotobar member has a diameter in the range of between about 2.0 and 3 inches and the ginning roller has a diameter of about 15 inches.

12. A roller gin as defined in claim 2, wherein the cylindrical path traversed by the edges of the four corners of the square cross section portion of said rotobar member has a diameter in the range of between about 2.0 and 3 inches and the ginning roller has a diameter of about 15 inches and the surface speed of the edges of said four corners during ginning being less than but within 90% of the surface speed of said ginning roller.

13. A roller cotton gin as defined in claim 2, including a driven auxiliary feed control roller located closely adjacent the surface of the ginning roller spaced a predetermined distance upstream from said rotobar member between the latter and the region where the seed cotton is fed to the ginning roller surface to facilitate even flow of cotton between the rotobar member and said surface and resist flow of seed cotton over the top of the rotobar member.

14. A roller cotton gin as defined in claim 2, including a comb structure adjacent the rotobar member for returning incompletely ginned cotton seeds to the pinch point for reprocessing comprising a rib-like comb spanning the blade formations having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

15. A roller gin as defined in claim 3, wherein the cylindrical path traversed by the edges of the four corners of the square cross section portion of said rotobar member has a diameter of between about one-fifth and one-seventh the diameter of the ginning roller.

16. A roller gin as defined in claim 3, wherein the cylindrical path traversed by the edges of the four corners of the square cross section portion of said rotobar member has a diameter in the range of between about 2.0 and 3 inches and the ginning roller has a diameter of about 15 inches.

17. A roller gin as defined in claim 3, wherein the cylindrical path traversed by the edges of the four corners of the square cross section portion of said rotobar member has a diameter in the range of between about 2.0 and 3 inches and the ginning roller has a diameter of about 15 inches and the surface speed of the edges of said four corners during ginning being less than but within 90% of the surface speed of said ginning roller.

18. A roller cotton gin as defined in claim 3, including a driven auxiliary feed control roller located closely adjacent the surface of the ginning roller spaced a predetermined distance upstream from said rotobar member between the latter and the region where the seed cotton is fed to the ginning roller surface to facilitate even flow of cotton between the rotobar member and said surface and resist flow of seed cotton over the top of the rotobar member.

19. A roller cotton gin as defined in claim 3, including a comb structure adjacent the rotobar member for returning incompletely ginned cotton seeds to the pinch point for reprocessing comprising a rib-like comb spanning the blade formations having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

20. A roller cotton gin comprising a ginning roller having a friction surface for conveying lint fibers to a pinch point station and a fixed knife for separating the lint fibers from cotton seed having an upstream facing working edge at the pinch point located substantially tangentially of and in contact with the surface of said ginning roller, a rotary stripping blade device comprising a rotary shaft having a plurality of circumferentially spaced radial blades continuously spanning the width of the gin, the edges of the blades being located to sweep through a cylindrical path whose diameter is a small fraction of the ginning roller diameter downwardly toward, over and forwardly beyond the edge of the knife, the successive blades effectively forming seed-receiving channels therebetween for advancing the seed cotton over the knife edge, means for rotating the ginning roller at a predetermined surface speed, means for feeding seed cotton to the surface of the ginning roller at a location upstream of said knife edge to cause the ginning roller to strip lint from seeds which are restrained by the knife edge and convey the lint to a point of removal, means for rotating said stripping blade device as a speed causing the surface speed of the edges of said blade surfaces to be slightly less than the surface speed of said ginning roller such as to restrain seeds in said seed-receiving channels during seed advancement over said knife edge while the ginning roller strips lint from such restrained seeds and then releasing the seeds from blade restraint at a release point spaced from said knife edge a distance such that fiber attached to any incompletely ginned seeds is sufficiently held between the knife and ginning roller to cause return of the incompletely ginned seed to the knife edge before the next blade applies advancing force to the seed, thereby to withdraw substantially all the fibers from the seed so long as sufficient fibers remain attached to the seed to continue drawing the seed back to the pinch point after each release thereof, the stripping blade device including a narrow strip-like pad of flexible material spanning the axial length thereof fixed on a surface of each channel of the stripping blade device positioned substantially midway between each successive pair of blades to press the seed locks in the channels against the ginning roller surface immediately upstream of said working edge and reduce the occurrence of unginned locks.

21. A roller cotton gin as defined in claim 20, wherein each of said pads are of sponge rubber material of about one-fourth inch thickness fixed to the bottom surface of each channel.

* * * * *